US007937016B2

(12) United States Patent
Kamijo et al.

(10) Patent No.: US 7,937,016 B2
(45) Date of Patent: May 3, 2011

(54) TRANSFER DEVICE AND IMAGE FORMING APPARATUS INCLUDING THE SAME

(75) Inventors: Koichi Kamijo, Matsumoto (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 437 days.

(21) Appl. No.: 12/207,319

(22) Filed: Sep. 9, 2008

(65) Prior Publication Data

US 2009/0074479 A1 Mar. 19, 2009

(30) Foreign Application Priority Data

Sep. 13, 2007 (JP) ..... 2007-237788
Jun. 3, 2008 (JP) ..... 2008-145727

(51) Int. Cl.

| | |
|---|---|
| ***G03G 21/00*** | (2006.01) |
| ***G03G 15/16*** | (2006.01) |
| ***G03G 15/00*** | (2006.01) |
| ***G03G 15/08*** | (2006.01) |
| ***G03G 15/01*** | (2006.01) |
| ***G03G 15/20*** | (2006.01) |

(52) U.S. Cl. ..... 399/98; 399/99; 399/101; 399/107; 399/110; 399/121; 399/297; 399/298; 399/299; 399/300; 399/301; 399/302; 399/303; 399/310; 399/313

(58) Field of Classification Search ..... 399/98, 399/99, 101, 107, 110, 121, 297–303, 310, 399/313

See application file for complete search history.

(56) References Cited

U.S. PATENT DOCUMENTS

| | | | | |
|---|---|---|---|---|
| 6,345,167 | B1 * | 2/2002 | Bean | 399/302 |
| 7,054,587 | B2 * | 5/2006 | Sohmiya et al. | 399/309 |
| 7,434,680 | B2 * | 10/2008 | Kitamura | 198/806 |
| 7,616,909 | B2 * | 11/2009 | Kato et al. | 399/49 |
| 2004/0126155 | A1 * | 7/2004 | Kobayashi et al. | 399/313 |

FOREIGN PATENT DOCUMENTS

| | | |
|---|---|---|
| JP | 2001-166611 | 6/2001 |

* cited by examiner

*Primary Examiner* — David P Porta
*Assistant Examiner* — Mindy Vu
(74) *Attorney, Agent, or Firm* — DLA Piper LLP (US)

(57) ABSTRACT

A transfer device includes: an image carrier belt; a first roller around which the image carrier belt is wound; a second roller around which the image carrier belt wound around the first roller and shifted; a first transfer roller contacting the first roller via the image carrier belt; a second transfer roller contacting the second roller via the image carrier belt; and a transfer belt wound around the first transfer roller and the second transfer roller. A width L3 of the image carrier belt and a width L4 of the transfer belt have the relationship of L3>L4.

9 Claims, 8 Drawing Sheets

TRANSFER DEVICE AND IMAGE FORMING APPARATUS INCLUDING THE SAME

BACKGROUND

1. Technical Field

The present invention relates to a transfer device for transferring liquid developer image transferred on an image carrier belt onto a transfer material such as paper, and to an image forming apparatus including the transfer device.

2. Related Art

Currently, such a type of liquid developer image forming apparatus has been proposed which includes a transfer unit for transferring a liquid developer image transferred on an image carrier belt onto a transfer material such as paper (for example, see JP-A-2001-166611). According to the transfer device included in the image forming apparatus disclosed in JP-A-2001-166611, a transfer roller is pressed against the image carrier belt such that the image carrier belt can be wound around the transfer roller. As a result, a circular arc transfer nip having a nip shape and a predetermined width in the shift direction of the transfer material is produced to provide preferable transfer characteristics.

According to the transfer device included in the image forming apparatus shown in JP-A-2001-166611, the transfer nip having a certain width is obtained in the shift direction of the transfer material. However, the possible width of the transfer nip to be produced is limited due to the structure which winds the image carrier belt around the transfer roller. Thus, improvement over the transfer efficiency is limited and difficult to be further raised.

Additionally, since the nip shape of the transfer nip is a circular arc having the same radius of curvature as that of the transfer roller and the predetermined width, the transfer material reaching the transfer nip is forcefully curved into a circular arc having the same shape. Thus, passing smoothness and separability of the transfer material at the transfer nip are not preferable. Moreover, a part of liquid developer on the image carrier belt reaches the end of the transfer roller at the time of transfer, thereby causing deterioration of the image.

SUMMARY

It is an advantage of some aspects of the invention to provide a transfer device capable of increasing transfer efficiency and improving passing smoothness and separability of transfer material at a transfer nip as well as preventing deterioration of images caused by liquid developer entering a transfer unit, and to provide an image forming apparatus including the transfer device.

A transfer device according to a first aspect of the invention includes: an image carrier belt; a first roller around which the image carrier belt is wound; a second roller around which the image carrier belt wound around the first roller and shifted; a first transfer roller contacting the first roller via the image carrier belt; a second transfer roller contacting the second roller via the image carrier belt; and a transfer belt wound around the first transfer roller and the second transfer roller. A width L3 of the image carrier belt and a width L4 of the transfer belt have the relationship of L3>L4. In this structure, the transfer material shifts while sandwiched between and closely contacting the image carrier belt and the transfer belt from the start position of the first transfer nip to the end position of the second transfer nip. Thus, preferable transfer can be performed. In addition, the transfer material is not greatly curved during shift, and the passing smoothness of the transfer material can be enhanced. In the condition L3>L4, adhesion of surplus liquid developer from the image carrier belt, and arrival of the liquid developer on the back surface of the transfer belt are prevented. Thus, deterioration of image quality is avoided.

According to the transfer device of the first aspect of the invention, it is preferable that the relationship between the width L4 of the transfer belt, a width L2 of the first transfer roller, and a width L7 of the second transfer roller have the relationship of L4>L2 and L4>L7. In this structure, an end of the transfer belt projecting from the end of the transfer roller is slightly deformed toward the inside. By the inward deformation of the end of the transfer belt, a clearance between the end of the transfer belt and the surface of the image carrier belt carrying the liquid developer image is produced. Thus, adhesion of surplus liquid developer to the transfer belt from the image carrier belt is prevented.

According to the transfer device of the first aspect of the invention, it is preferable to further include a transfer belt cleaner contacting the first transfer roller via the transfer belt. In this case, a width L5 of the transfer belt cleaner and the width L2 of the first transfer roller have the relationship of L5<L2. In this structure, liquid developer does not reach the back surface of the transfer belt, and the end of the transfer roller or the tension roller from the end of the transfer belt cleaner. Thus, deterioration of images can be prevented.

According to the transfer device of the first aspect of the invention, it is preferable to further include a tension roller which gives tension to the transfer belt, and a transfer belt cleaner contacting the tension roller via the transfer belt. In this case, the width L5 of the transfer belt cleaner and the width L8 of the tension roller have the relationship of L5<L8. In this structure, liquid developer does not reach the back surface of the transfer belt, and the end of the transfer roller or the tension roller from the end of the transfer belt cleaner. Thus, deterioration of images can be prevented.

According to the transfer device of the first aspect of the invention, it is preferable that beveled portions are formed at the ends of the first and second transfer rollers. In this structure, a clearance between the end of the transfer belt and the surface of the image carrier belt is produced to prevent adhesion of surplus liquid developer from the image carrier belt. Thus, arrival of the liquid developer on the back surface of the transfer belt and deterioration of images are avoided.

According to the transfer device of the first aspect of the invention, it is preferable to further include a bead provided at least one end of both ends of the transfer belt, and a pulley which guides the bead provided at least one end of both ends of the first and second transfer rollers as well as has a beveled portion at the end. In this structure, zigzag movement of the transfer belt is regulated, and preferable transfer is performed. Moreover, a clearance between the end of the transfer belt and the surface of the image carrier belt is secured, and adhesion of surplus liquid developer from the image carrier belt is prevented. Thus, arrival of the liquid developer on the back surface of the transfer belt and deterioration of image quality are avoided.

According to the transfer device of the first aspect of the invention, it is preferable to further include a bead provided at least one end of both ends of the image carrier belt, and a pulley which guides the bead provided at least one end of both ends of the first and second transfer rollers. In this case, widths L1 and L6 of the first and second rollers having the pulley and the width L3 of the image carrier belt have the relationship of L3>L1 or L3>L6. In this structure, zigzag movement of the image carrier belt is regulated, and preferable transfer free from color divergence can be performed.

According to the transfer device of the first aspect of the invention, it is preferable to further include flanges having outside diameters larger than those of the first and second rollers and disposed at both ends of the first and second rollers. Width L1*b* and width L6*b* of the first and second rollers including the flanges and the width L3 of the image carrier belt have the relationship of L3<L1*b* or L3>L6*b*. In this structure, zigzag movement of the image carrier belt is regulated, and preferable transfer free from color divergence can be performed.

An image forming apparatus according to a second aspect of the invention includes: a latent image carrier on which electrostatic latent image is formed; a developing device which develops the electrostatic latent image; an image carrier belt on which an image of the latent image carrier is transferred; a first roller around which the image carrier belt is wound; a second roller around which the image carrier belt wound around the first roller and shifted; a first transfer roller contacting the first roller via the image carrier belt; a second transfer roller contacting the second roller via the image carrier belt; and a transfer belt wound around the first transfer roller and the second transfer roller. A width L3 of the image carrier belt and a width L4 of the transfer belt have the relationship of L3>L4. In this structure, the transfer material shifts while sandwiched between and closely contacting the image carrier belt and the transfer belt from the start position of the first transfer nip to the end position of the second transfer nip. Thus, preferable transfer can be performed. In addition, the transfer material is not greatly curved during shift, and the passing smoothness of the transfer material can be enhanced. In the condition L3>L4, adhesion of surplus liquid developer from the image carrier belt, and arrival of the liquid developer on the back surface of the transfer belt are prevented. Thus, deterioration of image quality is avoided.

According to the image forming apparatus of the second aspect of the invention, it is preferable that the relationship between the width L4 of the transfer belt, a width L2 of the first transfer roller, and a width L7 of the second transfer roller have the relationship of L4>L2 and L4>L7. In this structure, an end of the transfer belt projecting from the end of the transfer roller is slightly deformed toward the inside. By the inward deformation of the end of the transfer belt, a clearance between the end of the transfer belt and the surface of the image carrier belt carrying the liquid developer image is produced. Thus, adhesion of surplus liquid developer to the transfer belt from the image carrier belt is prevented.

According to the image forming apparatus of the second aspect of the invention, it is preferable to further include a transfer belt cleaner contacting the first transfer roller via the transfer belt. In this case, the width L5 of the transfer belt cleaner and the width L2 of the first transfer roller have the relationship of L5<L2. In this structure, liquid developer does not reach the back surface of the transfer belt, and the end of the transfer roller or the tension roller from the end of the transfer belt cleaner. Thus, deterioration of images can be prevented.

According to the image forming apparatus of the second aspect of the invention, it is preferable that beveled portions are formed at the ends of the first and second transfer rollers. In this structure, a clearance between the end of the transfer belt and the surface of the image carrier belt is produced to prevent adhesion of surplus liquid developer from the image carrier belt. Thus, arrival of the liquid developer on the back surface of the transfer belt and deterioration of images are avoided.

According to the image forming apparatus of the second aspect of the invention, it is preferable to further include a bead provided at least one end of both ends of the transfer belt, and a pulley which guides the bead provided at least one end of both ends of the first transfer roller and/or the second transfer roller and has a beveled portion at the end. In this structure, zigzag movement of the transfer belt is regulated, and preferable transfer is performed. Moreover, a clearance between the end of the transfer belt and the surface of the image carrier belt is secured, and adhesion of surplus liquid developer from the image carrier belt is prevented. Thus, arrival of the liquid developer on the back surface of the transfer belt and deterioration of image quality are avoided.

According to the image forming apparatus of the second aspect of the invention, it is preferable to further include a bead provided at least one end of both ends of the image carrier belt, and a pulley which guides the bead provided at least one end of both ends of the first transfer roller and/or the second transfer roller. In this case, widths L1 and L6 of the first and second rollers having the pulley and the width L3 of the image carrier belt have the relationship of L3>L1 or L3>L6. In this structure, zigzag movement of the image carrier belt is regulated, and preferable transfer free from color divergence can be performed.

According to the image forming apparatus of the second aspect of the invention, it is preferable to further include flanges having outside diameters larger than those of the first and second rollers and disposed at both ends of the first and second rollers. Width L1*b* and width L6*b* of the first and second rollers including the flanges and the width L3 of the image carrier belt have the relationship of L3<L1*b* or L3<L6*b*. In this structure, zigzag movement of the image carrier belt is regulated, and preferable transfer free from color divergence can be performed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Preferred embodiments according to the invention are hereinafter described with reference to the drawings.

Figure 1:
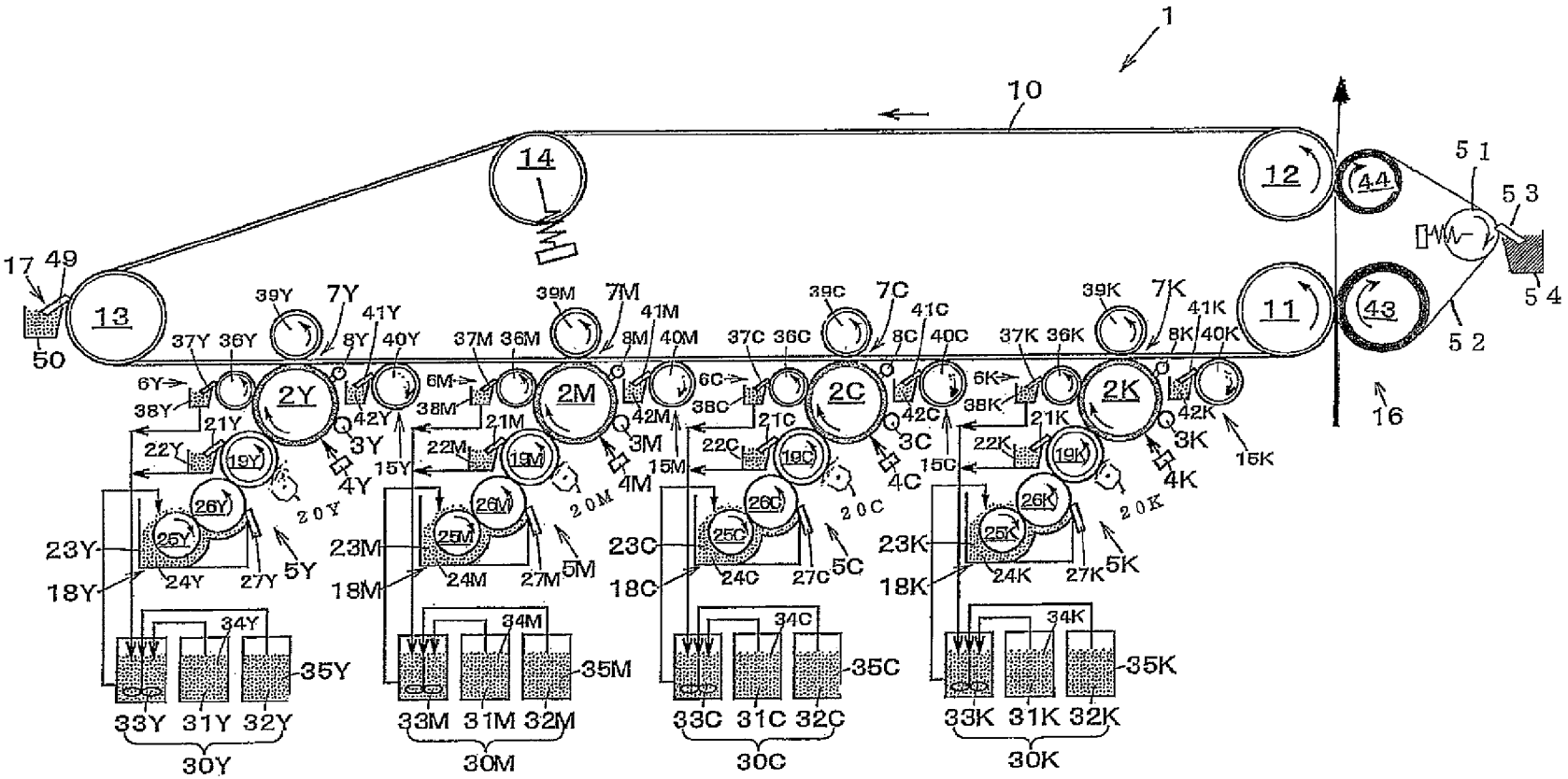
FIG. 1 illustrates an embodiment of the invention.

FIG. 1 schematically illustrates a part of an image forming apparatus according to an embodiment of the invention.

As illustrated in FIG. 1, an image forming apparatus 1 in this embodiment includes photosensitive bodies 2Y, 2M, 2C, and 2K as latent image carriers for yellow (Y), magenta (M), cyan (C), and black (B) disposed in tandem. The photosensitive bodies 2Y, 2M, 2C, and 2K correspond to yellow sensitive body, magenta sensitive body, cyan sensitive body, and black sensitive body, respectively. Other components are similarly represented by adding the respective colors Y, M, C, and K to the symbols of the components. According to the example shown in FIG. 1, the respective photosensitive bodies 2Y, 2M, 2C, and 2K are constituted by photosensitive drums. The photosensitive bodies 2Y, 2M, 2C, and 2K may have endless shapes.

These photosensitive bodies 2Y, 2M, 2C, and 2K rotate clockwise in the directions indicated by arrows shown in FIG. 1 during operation. Electrifiers 3Y, 3M, 3C, and 3K, exposing units 4Y, 4M, 4C, and 4K, developing devices 5Y, 5M, 5C, and 5K, photosensitive body squeezing devices 6Y, 6M, 6C, and 6K, primary transfer devices 7Y, 7M, 7C, and 7K, and charge removers 8Y, 8M, 8C, and 8K are provided around the photosensitive bodies 2Y, 2M, 2C, and 2K in this order from the upstream side of the rotation direction of the photosensitive bodies 2Y, 2M, 2C, and 2K. Not-shown photosensitive body cleaning units are disposed between the charge removers 8Y, 8M, 8C, and 8K and the electrifiers 3Y, 3M, 3C, and 3K.

An image forming apparatus 1 has an endless intermediate transfer belt 10 as an intermediate transfer medium. The intermediate transfer belt 10 wound around the belt driving roller 11 to which driving force of a not-shown motor is transmitted and a pair of following rollers 12 and 13 is rotatable anticlockwise as shown in FIG. 1. In this case, the belt driving roller 11 and the following roller 12 are disposed adjacent to each other with a predetermined clearance therebetween in the shift direction of a transfer material such as paper to be transferred indicated by an arrow. The belt driving roller 11 and the other following roller 13 are disposed away from each other in the tandem direction of the photosensitive bodies 2Y, 2M, 2C, and 2K. Predetermined tension is given to the intermediate transfer belt 10 by a tension roller 14 for slack removal. The tension roller 14 is disposed downstream from the one following roller 12 in the rotation (shift) direction of the intermediate transfer belt 10, and upstream from the other following roller 13 in the rotation (shift) direction of the intermediate transfer belt 10.

Figure 3:
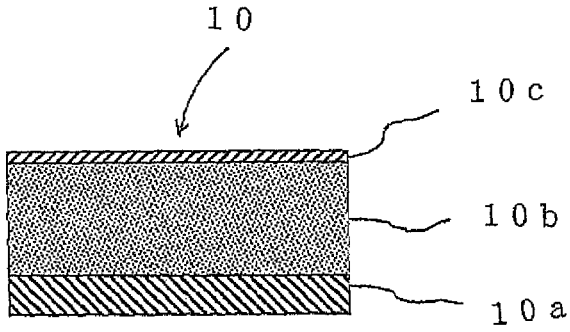
FIG. 3 illustrates a further embodiment of the invention.

As illustrated in FIG. 3, the intermediate transfer belt 10 has a multilayer structure constituted by a base layer 10*a*, an elastic layer 10*b* laminated on the base layer 10*a*, and a coat layer 10*c* on the surface of the elastic layer 10*b*. The intermediate transfer belt 10 having the multilayer structure containing the elastic layer 10*b* has appropriate elasticity in the thickness direction, and thus improves transferability of the liquid developer images from the photosensitive bodies 2Y, 2M, 2C, and 2K and transferability onto the transfer material. Particularly, the intermediate transfer belt 10 has preferable transferability having large concaves and convexes, and can transfer clear images on concaves. The substrate layer 10*a* is made of polyimide resin, polyamideimide resin, or other material. The elastic layer 10*b* is made of conductive polyurethane rubber or the like. The coat layer 10*c* is made of fluororesin or the like.

According to the image forming apparatus 1 in this embodiment, the photosensitive bodies 2Y, 2M, 2C, and 2K and the developing devices 5Y, 5M, 5C, and 5K are disposed in the order of the colors Y, M, C, and K from the upstream side of the rotation direction of the intermediate transfer belt 10. However, the position order of the colors Y, M, C and K can be arbitrarily determined.

Intermediate transfer belt squeeze units 15Y, 15M, 15C, and 15K are disposed in the vicinity of the primary transfer devices 7Y, 7M, 7C, and 7K downstream from the primary transfer devices 7Y, 7M, 7C, and 7K in the rotation direction of the intermediate transfer belt 10. Furthermore, a secondary transfer device 16 is provided on the belt driving roller 11 side of the intermediate transfer belt 10, and an intermediate transfer belt cleaning unit 17 is provided on the following roller 13 side of the intermediate transfer belt 10.

Though not shown in the figure, the image forming apparatus 1 in this embodiment includes a transfer material storage unit for storing transfer material such as paper upstream from the secondary transfer device 16 in the transfer material shift direction, and a pair of resist rollers for supplying the transfer material from the transfer material storage unit toward the secondary transfer device 16 similarly to a typical image forming apparatus for performing secondary transfer. The image forming apparatus 1 similarly includes a fixing unit and a sheet discharge tray disposed downstream from the secondary transfer device 16 in the transfer material shift direction.

Each of the electrifiers 3Y, 3M, 3C, and 3K is constituted by an electrifying roller, for example. Bias voltage having the same polarity as that of the electrification polarity of the liquid developer is applied to each of the electrifiers 3Y, 3M, 3C, and 3K from a not-shown power source device. The electrifiers 3Y, 3M, 3C, and 3K electrify the corresponding photosensitive bodies 2Y, 2M, 2C, and 2K. The exposing units 4Y, 4M, 4C, and 4K form electrostatic latent images on the corresponding electrified photosensitive bodies 2Y, 2M, 2C, and 2K by applying laser beams emitted from a laser scanning system, for example.

The developing devices 5Y, 5M, 5C, and 5K have developer supply units 18Y, 18M, 18C, and 18K, developing rollers 19Y, 19M, 19C, and 19K, toner electrifying corona electrifiers 20Y, 20M, 20C, and 20K, developing roller cleaners 21Y, 21M, 21C, and 21K, and developing roller cleaner collect liquid storage units 22Y, 22M, 22C, and 22K.

The developer supply units 18Y, 18M, 18C and 18K have developer containers 24Y, 24M, 24C, and 24K for containing liquid developers 23Y, 23M, 23C, and 23K constituted by toner particles and non-volatile liquid carriers, developer drawing rollers 25Y, 25M, 25C, and 25K, anilox rollers 26Y, 26M, 26C, and 26K, and developer regulating blades 27Y, 27M, 27C, and 27K.

Toners of the liquid developers 23Y, 23M, 23C, and 23K contained in the developer containers 24Y, 24M, 24C, and 24K are particles having average particle diameter of 1 μm and containing coloring agent such as known pigment dispersed in known thermoplastic resin for toners. In case of liquid developer having low viscosity and low concentration, liquid carrier may be insulation liquid carrier such as Isopar (trademark: produced by Exxon Co.). In case of liquid developer having high viscosity and high concentration, liquid carrier may be silicon oil having flash point of 210 degrees or higher such as organic solvent, phenyl methyl siloxane, dimethyl polysiloxane, and polydimethyl siloxane, mineral oil, relatively low-viscosity aliphatic saturated hydrocarbon such as liquid paraffin having boiling point of 170 degrees or higher and relatively low viscosity of 3 mPa·s at 40 degrees, normal paraffin, vegetable oil, edible oil, higher fatty acid ester, or other insulation liquid carriers. The liquid developers 23Y, 23M, 23C, and 23K are formed by adding toner particles to liquid carriers together with dispersant to obtain toner solid concentration of approximately 20%.

The developer drawing rollers 25Y, 25M, 25C, and 25K draw the liquid developers 23Y, 23M, 23C, and 23K contained in the developer containers 24Y, 24M, 24C, and 24K and supplies the drawn liquid developers 23Y, 23M, 23C, and 23K to the anilox rollers 26Y, 26M, 26C, and 26K. The developer drawing rollers 25Y, 25M, 25C, and 25K rotate clockwise in the direction indicated by the arrow in FIG. 1. Each of the anilox rollers 26Y, 26M, 26C, and 26K has a cylindrical shape and a fine and uniform spiral groove on the surface. According to the dimensions of the groove, the groove pitch is about 170 μm, and the groove depth is about 30 μm, for example. Obviously, the dimensions of the groove are not limited to these values. The anilox rollers 26Y, 26M, 26C, and 26K rotate anticlockwise in the direction shown by the arrow in FIG. 1 as the same direction of the developing rollers 19Y, 19M, 19C, and 19K. The anilox rollers 26Y, 26M, 26C, and 26K may rotate by following the rotations of the developing rollers 19Y, 19M, 19C, and 19K. Thus, the rotation directions of the anilox rollers 26Y, 26M, 26C, and 26K are not limited but arbitrarily determined.

The developer regulating blades 27Y, 27M, 27C, and 27K contact the surfaces of the anilox rollers 26Y, 26M, 26C, and 26K. The developer regulating blades 27Y, 27M, 27C, and 27K have rubber portions formed by urethane rubber or the like contacting the corresponding surfaces of the anilox rollers 26Y, 26M, 26C, and 26K, and plates for supporting the rubber portions such as metal plates. The developer regulating blades 27Y, 27M, 27C, and 27K scrape liquid developers adhering to the surfaces of the anilox rollers 26Y, 26M, 26C, and 26K other than the grooves thereof by using the rubber portions to remove the remaining liquid developers. Thus, the anilox rollers 26Y, 26M, 26C, and 26K supply only liquid developer adhering to the inside of the grooves to the developing rollers 19Y, 19M, 19C, and 19K.

Each of the developing rollers 19Y, 19M, 19C, and 19K is a cylindrical component having approximately 320 mm in width, and has an elastic body such as conductive urethane rubber, a resin layer, and a rubber layer on the outer periphery of the metal shaft such as iron shaft. The developing rollers 19Y, 19M, 19C, and 19K contact the photosensitive bodies 2Y, 2M, 2C, and 2K, and rotate anticlockwise in the direction indicated by the arrow in FIG. 1.

Voltage is applied to the toner electrifying corona electrifiers 20Y, 20M, 20C, and 20K such that the electrifiers 20Y, 20M, 20C, and 20K can electrify the corresponding developing rollers 19Y, 19M, 19C, and 19K.

The developing roller cleaners 21Y, 21M, 21C, and 21K are constituted by rubber or the like contacting the surfaces of the corresponding developing rollers 19Y, 19M, 19C, and 19K to scrape and remove the developers remaining on the developing rollers 19Y, 19M, 19C, and 19K. The developing roller cleaner collect liquid storing units 22Y, 22M, 22C, and 22K are containers such as tanks for storing developers scraped from the developing rollers 19Y, 19M, 19C, and 19K.

The image forming apparatus 1 in this embodiment further includes developer replenishing devices 30Y, 30M, 30C, and 30K for replenishing the liquid developers 23Y, 23M, 23C, and 23K to the developer containers 24Y, 24M, 24C, and 24K. The developer replenishing devices 30Y, 30M, 30C, and 30K have toner tanks 31K, 31M, 31C, and 31K, and carrier tanks 32Y, 32M, 32C, and 32K, and stirring units 33Y, 33M, 33C, and 33K.

The toner tanks 31Y, 31M, 31C, and 31K contain high-concentration liquid toners 34Y, 34M, 34C, 34K. The carrier tanks 32Y, 32M, 32C, and 32K contain liquid carriers (carrier oils) 35Y, 35M, 35C, and 35K. Predetermined amounts of high-concentration liquid toners 34Y, 34M, 34C, and 34K from the toner tanks 31Y, 31M, 31C, and 31K and predetermined amounts of liquid carriers 35Y, 35M, 35C, and 35K from the carrier tanks 32Y, 32M, 32C, and 32K are supplied to the stirring devices 33Y, 33M, 33C, and 33K.

The stirring devices 33Y, 33M, 33C, and 33K produce the liquid developers 23Y, 23M, 23C, and 23K used by the developing devices 5Y, 5M, 5C, and 5K by mixing and stirring the supplied high-concentration liquid toners 34Y, 34M, 34C, and 34K and the liquid carriers 35Y, 35M, 35C, and 35K. The liquid developers 23Y, 23M, 23C, and 23K produced by the stirring devices 33Y, 33M, 33C, and 33K are supplied to the developer containers 24Y, 24M, 24C, and 24K.

The photosensitive squeezing devices 6Y, 6M, 6C, and 6K have squeeze rollers 36Y, 36M, 36C, and 36K, squeeze roller cleaners 37Y, 37M, 37C, and 37K, and squeeze roller cleaner collect liquid storage containers 38Y, 38M, 38C, and 38K. The squeeze rollers 36Y, 36M, 36C, and 36K are disposed downstream from the contact portions (nip portions) between the photosensitive bodies 2Y, 2M, 2C, and 2K, and the developing rollers 19Y, 19M, 19C, and 19K in the rotation direction of the photosensitive bodies 2Y, 2M, 2C, and 2K. The squeeze rollers 36Y, 36M, 26C, and 36K rotate in the direction opposite to the direction of the photosensitive bodies 2Y, 2M, 2C, and 2K (anticlockwise in FIG. 1) to remove liquid carriers on the photosensitive bodies 2Y, 2M, 2C, and 2K.

Each of the squeeze rollers 36Y, 36M, 36C, and 36K is preferably formed by an elastic roller having an elastic material such as conductive urethane rubber and a fluororesin surface layer on the surface a metal core. The squeeze roller cleaners 37Y, 37M, 37C, and 37K are constituted by elastic bodies such as rubbers, and contact the surfaces of the corresponding squeeze rollers 36Y, 36M, 36C, and 36K to scrape and remove the liquid carriers remaining on the squeeze rollers 36Y, 36M, 36C, and 36K. The squeeze roller cleaner collect liquid storage containers 38Y, 38M, 38C, and 38K are containers such as tanks for storing developers scraped by the corresponding squeeze roller cleaners 37Y, 37M, 37C, and 37K.

The primary transfer devices 7Y, 7M, 7C, and 7K have primary transfer backup rollers 39Y, 39M, 39C, and 39K for achieving contact between the intermediate transfer belt 10 and the photosensitive bodies 2Y, 2M, 2C, and 2K. The backup rollers 39Y, 39M, 39C, and 39K receive about −200V having polarity opposite to that of the electrification polarity of toner particles, for example, to primarily transfer toner images (liquid developer images) in respective colors formed on the photosensitive bodies 2Y, 2M, 2C, and 2K onto the intermediate transfer belt 10. The charge removers 8Y, 8M, 8C, and 8K remove charges remaining on the photosensitive bodies 2Y, 2M, 2C, and 2K after primary transfer.

The intermediate transfer belt squeezing devices 15Y, 15M, 15C, and 15K have intermediate transfer belt squeeze rollers 40Y, 40M, 40C, and 40K, intermediate transfer belt squeeze roller cleaners 41Y, 41M, 41C, and 41K, intermediate belt squeeze roller cleaner collect liquid storage containers 42Y, 42M, 42C, and 42K. The intermediate transfer belt squeeze rollers 40Y, 40M, 40C, and 40K collect liquid carriers in the corresponding colors on the intermediate transfer belt 10. The intermediate transfer belt squeeze roller cleaners 41Y, 41M, 41C, and 41K scrape the collected liquid carriers on the intermediate transfer belt squeeze rollers 40Y, 40M, 40C, and 40K. The intermediate transfer belt squeeze roller cleaners 41Y, 41M, 41C, and 41K are formed by elastic bodies such as rubbers or the like similarly to the squeeze roller cleaners 37Y, 37M, 37C, and 37K. The intermediate transfer belt squeeze roller cleaner collect liquid storage containers 42Y, 42M, 42C, and 42K collect and store the liquid carriers scraped by the intermediate transfer belt squeeze roller cleaners 41Y, 41M, 41C, and 41K.

The secondary transfer device 16 has a pair of secondary transfer rollers disposed with a predetermined clearance therebetween in the transfer material shift direction. The secondary transfer roller of the pair of the rollers disposed on the upstream side in the shift direction of the transfer material is a first secondary transfer roller 43. The secondary transfer roller of the pair of the rollers disposed on the downstream side in the shift direction of the transfer material is a second secondary transfer roller 44. An endless transfer material support belt 52 is wound around the first and second transfer rollers 43 and 44. In this structure, tension is given to the transfer material belt 52 by the tension roller 51. The first and second secondary transfer rollers 43 and 44 can contact the belt driving roller 11 and the following roller 12 via the intermediate transfer belt 10 and the transfer material support belt 52. The transfer material support belt 52 is driven by the first secondary transfer roller 43, and tension is given to the transfer material support belt 52 by the tension roller 51. The transfer material support belt 52 is made of polyimide resin or polyamideimide resin.

More specifically, the transfer material support belt 52 wound around the first and second secondary transfer rollers 43 and 44 bring the transfer material into close contact with the intermediate transfer belt 10 wound around the belt drive roller 11 and the following roller 12, and secondarily transfer a color toner image (liquid developer image) as a combination of toner images in respective colors formed on the intermediate transfer belt 10 onto the transfer material while shifting the transfer material closely contacting the intermediate transfer belt 10.

In this case, the belt drive roller 11 and the following roller 12 also function as backup rollers for the secondary transfer rollers 43 and 44 at the time of secondary transfer, respectively. More specifically, the belt drive roller 11 is also used as a first backup roller disposed on the secondary transfer device 16 on the upstream side from the following roller 12 in the shift direction of the transfer material, and the following roller 12 is also used as a second backup roller disposed on the secondary transfer device 16 on the downstream side from the belt driving roller 11 in the shift direction of the transfer material.

The diameter of the second secondary transfer roller 44 is smaller than that of the following roller 12. Thus, the transfer material is sandwiched between the intermediate transfer belt 10 and a transfer material support belt 52, and the passing smoothness of the transfer material at the secondary transfer position can be preferably maintained. Also, the transfer material is easily separated from the intermediate transfer belt 10 after passing through the press contact position between the second secondary transfer roller 44 and the following roller 12.

The secondary transfer device 16 has a transfer material support belt cleaner 53 and a transfer material support belt cleaner collect liquid storage container 54 for the transfer material support belt 52. The transfer material support belt cleaner 53 is formed by an elastic body such as rubber similarly to the squeeze roller cleaners 37Y, 37M, 37C, and 37K. The transfer material support belt cleaner 53 contacts the tension roller 51 via the transfer material support belt 52 to scrape and remove foreign material such as liquid developer remaining on the surface of the transfer material support belt 52 after secondary transfer. The transfer support belt cleaner 53 may contact the first secondary transfer roller 43 via the transfer material support belt 52 to scrape and remove foreign material such as liquid developer remaining on the surface of the transfer material support belt 52 after secondary transfer. The transfer material support belt cleaner collect liquid storage container 54 collects the developer scraped from the transfer material support belt 52 by the transfer material support belt cleaner 53 and stores the collected developer. Thus, the next transfer material is free from the effect of foreign material such as liquid developer adhering to the transfer material support belt 52.

The first secondary transfer roller 43 contacts the belt drive roller 11 via the intermediate transfer belt 10 and the transfer material support belt 52. Accordingly, close contact between the transfer material and the intermediate transfer belt 10 is securely achieved at the time of the start of entrance of the transfer material to the press contact position between the belt drive roller 11 and the first secondary transfer roller 43. As a result, transfer of the liquid developer image from the intermediate transfer belt 10 to the transfer material is securely initiated. Moreover, the transfer material having passed through the press contact position between the belt drive roller 11 and the first secondary transfer roller 43 is sandwiched between the intermediate transfer belt 10 and the transfer material support belt 52. Thus, separation (floating) of the transfer material from the intermediate transfer belt 10 is prevented. Accordingly, further preferable transfer can be performed. Furthermore, the transfer material support belt 52 is disposed parallel with the intermediate transfer belt 10 from the contact position between the first secondary transfer roller 43 and the belt drive roller 11 to the contact position between the second secondary transfer roller 44 and the following roller 12. Thus, the transfer material can closely contacts the intermediate transfer belt 10 in a stable manner while shifting the area between these contact positions. Accordingly, the transfer efficiency further improves, and transferability of the transfer material further enhances.

When the transfer material starts entering the contact portion between the belt drive roller 11 and the first secondary transfer roller 43 and the contact portion of the following roller 12 and the second secondary transfer roller 44, both the intermediate transfer belt 10 and the transfer material support belt 52 receive resistance and tend to produce looseness. However, tension is given to the intermediate transfer belt 10 and the transfer support belt 52, and the intermediate transfer belt 10 and the transfer material support belt 52 are kept tensioned even when the intermediate transfer belt 10 and the transfer material support belt 52 receive resistance possibly causing looseness. Thus, transfer from the intermediate transfer belt 10 onto the transfer material can be efficiently performed in the area from the press contact position between the belt drive roller 11 and the first secondary transfer roller 43 and the press contact position between the following roller 12 and the second secondary transfer roller 44. Moreover, transfer material can be more stably and securely supported and shifted by using the transfer material support belt 52.

Figure 2:
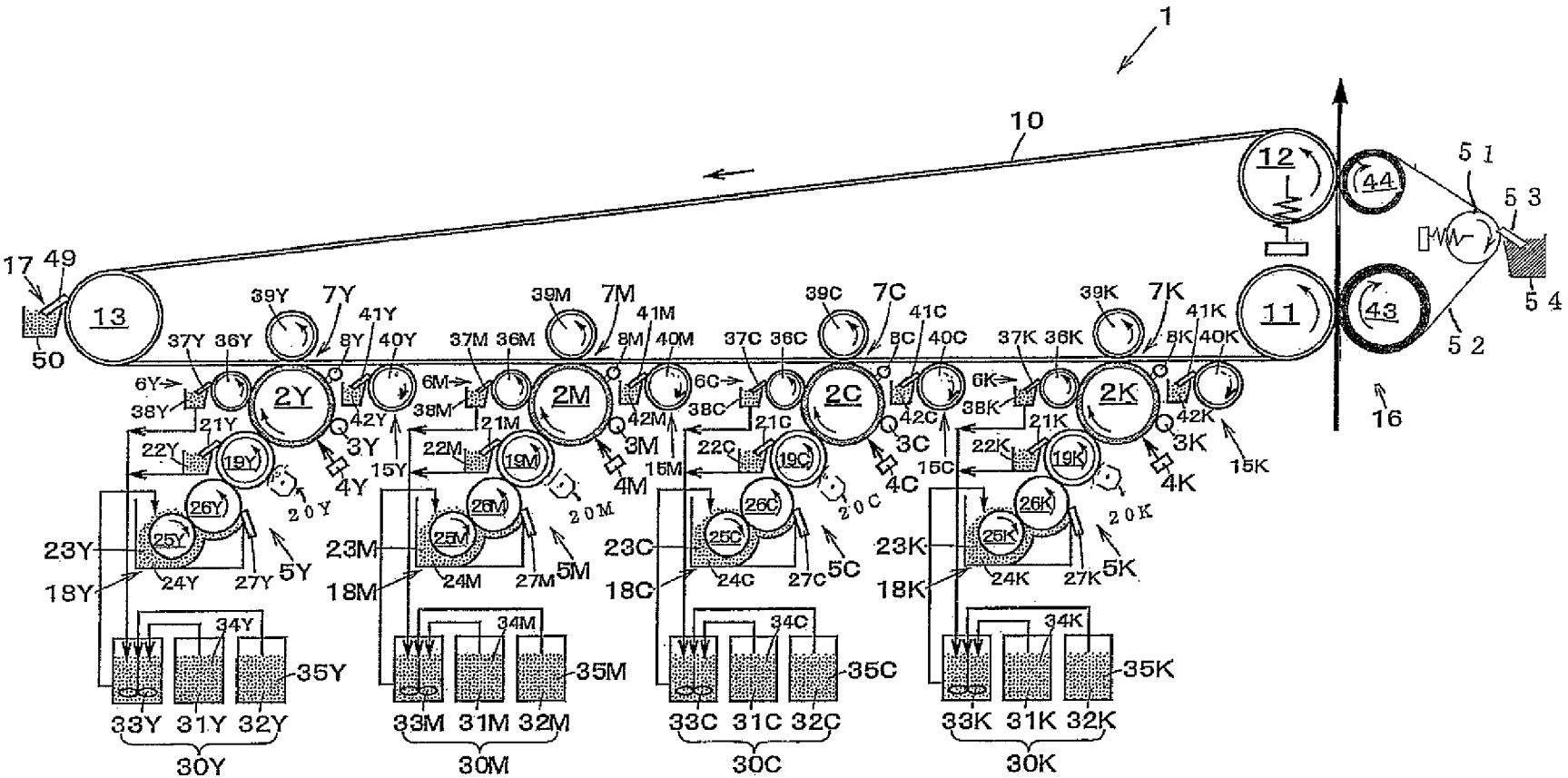
FIG. 2 illustrates another example of the invention.

FIG. 2 schematically illustrates a part of an image forming apparatus according to another embodiment of the invention. Similar reference numbers are given to parts and elements similar to those in the embodiment discussed above, and the same detailed explanation is not repeated. While the image forming apparatus 1 shown in FIG. 1 gives tension to the intermediate transfer belt 10 by using the tension roller 14, the image forming apparatus 1 in this embodiment does not have the tension roller 14 as can be seen from FIG. 2. According to this embodiment, the image forming apparatus 1 gives tension to the intermediate transfer belt 10 by using the following roller 12. Thus, the following roller 12 also functions as the tension roller for giving tension to the intermediate transfer belt 10. In this case, the necessity for equipping an exclusively used tension roller is eliminated. Thus, the image forming apparatus 1 can reduce the number of components and the device size while efficiently performing transfer onto the transfer material. Other components and parts and other operation and advantages are similar to those in the above embodiment.

The belt drive roller 11 (first backup roller), the first secondary transfer roller 43, the following roller 12 (secondary backup roller), the second secondary transfer roller 44, the intermediate transfer belt 10, and the transfer material support belt 52 included in the transfer device according to the first embodiment are shown in Table 1.

TABLE 1

| | | Outside diameter | Hardness | Surface layer thickness | Electric resistance |
|---|---|---|---|---|---|
| Following roller 12 (Second backup roller) | | ϕ30 mm | hardness 40°(H1) | 2.5 mm | log7 |
| Second secondary transfer roller 44 | | ϕ20 mm | hardness 80°(H4) | 1.0 mm | log7 |
| Belt drive roller 11 (First backup roller) | | ϕ30 mm | hardness 60°(H2) | 0.5 mm | log7 |
| First secondary transfer roller 43 | | ϕ30 mm | hardness 40°(H3) | 2.5 mm | log7 |
| Intermediate transfer belt 10 | Base layer 10a (Polyimide) | | | 80 μm | log9 |
| | Elastic layer 10b (Conductive urethane rubber) | | hardness 30°(H5) | 600 μm | log9 |
| | Surface layer 10c (Fluororesin) | | | 10 μm | log10 |
| Transfer material support belt 52 Polyimide | | | | 80 μm | log9 |
| Surface layer side hardness of following roller 12 around which intermediate transfer belt is wound | | | hardness 60°(H6) | | |
| Hardness of 2nd secondary transfer roller 44 around which transfer material support belt 52 is wound | | | hardness 90°(H7) | | |

The hardness (H1 through H4) of each roller (11, 12, 43, and 44) is measured as type A in conformity with JIS-K6253. The hardness H5 of the elastic layer 10*b* of the intermediate transfer belt 10 is measured by removing the surface layer (coat layer) 10*c* and the base layer 10*a* to leave the elastic layer 10*b* only, and laminating layers in conformity with JIS-K6253 to measure the elastic layer 10*b* having a thickness of approximately 6 mm. The hardness H5 may be measured based on IRHD scale in conformity with JIS-K6253 with the surface layer 10*c* separated. The surface layer side hardness H6 of the following roller 12 around which the intermediate transfer belt 10 is wound is measured based on the IRHD scale in conformity with JIS-K-6253. As described in JIS-K6253, the type A and the IRHD hardness can be used as the same rubber hardness level as shown in JIS-K6253. Thus, these scales are effective for comparison of which is higher or lower. The electric resistance is measured by highrester or UR probe with 250V applied.

Figure 4:
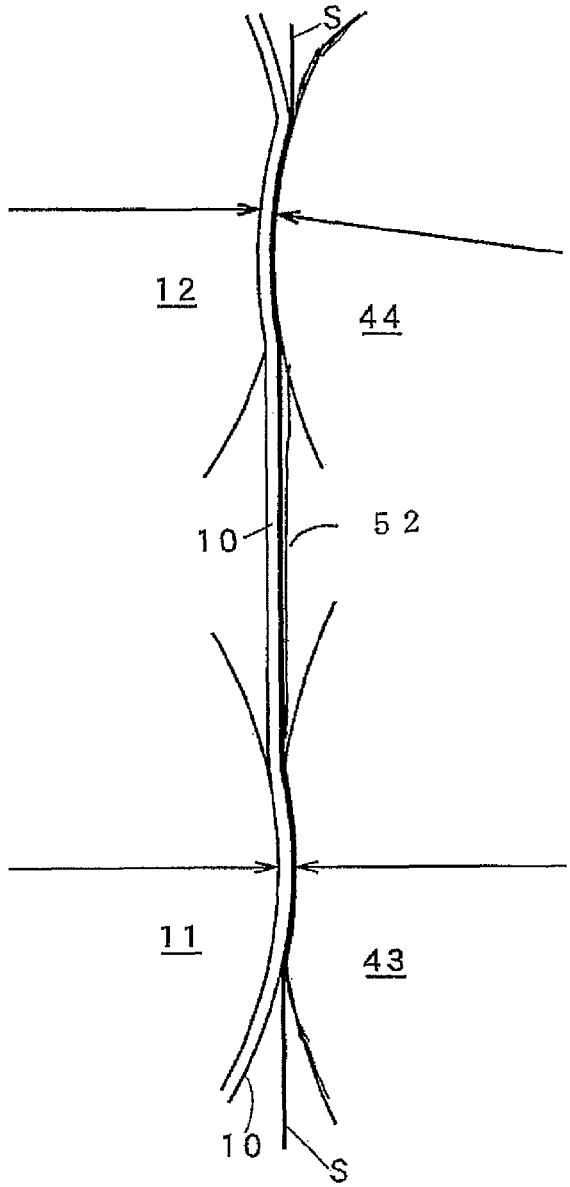
FIG. 4 illustrates a still further embodiment of the invention.

FIG. 4 shows the shape of the transfer nip of the secondary transfer device 16 when the hardness (H1 through H4) of the rollers (11, 12, 43, and 44), the hardness H5 of the elastic layer 10*b* of the intermediate transfer belt 10, the hardness H6 of the following roller 12 around which the intermediate transfer belt 10 is wound, and the hardness H7 of the transfer material support belt 52 wound around second secondary transfer roller 44 are set at the values shown in Table 1.

As illustrated in FIG. 4, the hardness H2 (60°) of the belt drive roller 11 is larger than the hardness H3 of the first secondary transfer roller 43 (40°) at the first transfer nip of the secondary transfer device 16. When H2>H3, the first transfer nip as the press contact portion between the first secondary transfer roller 43 and the belt drive roller 11 via the intermediate transfer belt 10 and the transfer material support belt 52 becomes a curved surface concaved on the first secondary transfer roller 43 side. In this case, the width of the transfer nip can be secured, and transferability can be enhanced. Moreover, collect of the surplus carrier from the liquid developer image on the intermediate transfer belt 10 can be increased.

The hardness H4 (80°) of the second transfer roller 44 is larger than the hardness H1 (40°) of the following roller 12 (second backup roller). The hardness H4 of the following roller 12 (second backup roller) is larger than the hardness H5 (30°) of the elastic layer 10*b* of the intermediate transfer belt 10. The surface layer side hardness HG (60°) of the following roller 12 (second backup roller) around which the intermediate transfer belt 10 is wound is smaller than the hardness H7 (90°) of the second secondary transfer roller 44 around which the transfer material support belt 52 is wound. When the second secondary transfer roller 44 press-contacts the following roller 12 (second backup roller) via the intermediate transfer belt 10 and the transfer material support belt 52 at the time of secondary transfer under the condition of H6<H7 as illustrated in FIG. 4, the press contact portion of the second secondary transfer roller 44 (second transfer nip) becomes a curved surface concaved on the following roller 12 side with the intermediate transfer belt 10. Thus, the separability of the transfer material S on the press contact portion (second transfer nip) of the second secondary transfer roller 44 is increased, and winding of the transfer material S around the intermediate transfer belt 10 can be prevented.

According to the transfer device having this structure, liquid developer reaches from the end to the back surface of the transfer material support belt 52. When the liquid developer comes to the back surface of the transfer material support belt 52, deterioration of image quality such as local decrease in the transfer efficiency on the transfer material such as paper is caused. According to the transfer device in this embodiment, therefore, a width L3 of the intermediate transfer belt 10 is larger than a width L4 of the transfer material support belt 52 to prevent image deterioration caused by the liquid developer reaching the back surface of the transfer material support belt 52. Under the condition of L3>L4, adhesion of surplus liquid developer to the transfer material support belt 52 from the end of the intermediate transfer belt 10, and thus arrival of the liquid developer on the back surface of the transfer belt can be prevented.

Figure 5:
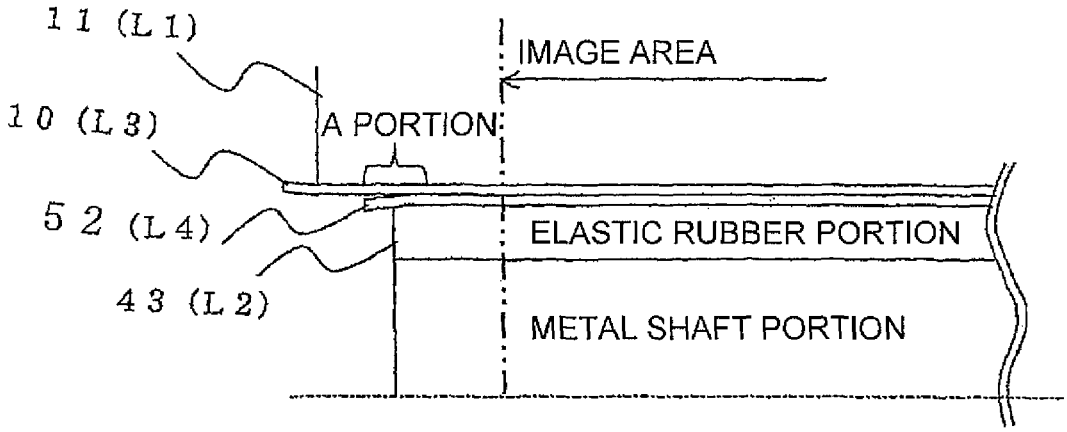
FIG. 5 illustrates a still further embodiment of the invention.

FIG. 5 illustrates a secondary transfer unit for preventing arrival of the liquid developer on the back surface of the transfer material support belt 52 in the first embodiment. According to the secondary transfer unit in the first embodiment, the width L3 of the intermediate transfer belt 10 is larger than the width L4 of the transfer material support belt 52. In this structure, both ends of the intermediate transfer belt 10 are positioned away from both ends of the transfer material support belt 52. Thus, adhesion of the liquid developer to the transfer material support belt 52 from the end of the intermediate transfer belt 10 is prevented. Accordingly, the liquid developer does not reach the back surface from the end of the transfer material support belt 52.

According to the secondary transfer unit in the first embodiment, the width L3 of the intermediate transfer belt 10 is larger than a width L1 of the belt drive roller 11, the width L4 of the transfer material support belt 52 is larger than each of width L2 and width L7 of the first secondary transfer roller 43 and the second secondary transfer roller 44, and the width L4 of the transfer material support belt 52 is smaller than the width L1 of the belt drive roller 11. In this arrangement, the end of the transfer material support belt 52 positioned out of the image area is pressed by the first secondary transfer roller 43 having an elastic layer on the surface and located inside. As a result, an end (A portion) of the transfer material support belt 52 projecting from the end of the first secondary transfer roller 43 is slightly deformed toward the inside. By the inward deformation of the end of the transfer material support belt 52, a clearance between the end of the transfer material support belt 52 and the surface of the intermediate transfer belt 10 carrying the liquid developer image is produced. In this case, adhesion of the surplus liquid developer to the transfer material support belt 52 from the intermediate transfer belt 10 is prevented. While the contact portion between the belt drive roller (first backup roller) and the first secondary transfer roller 43 is shown in FIG. 5, similar advantage is offered on the contact portion between the following roller 12 (second backup roller) and the second secondary transfer roller 44.

Figure 6:
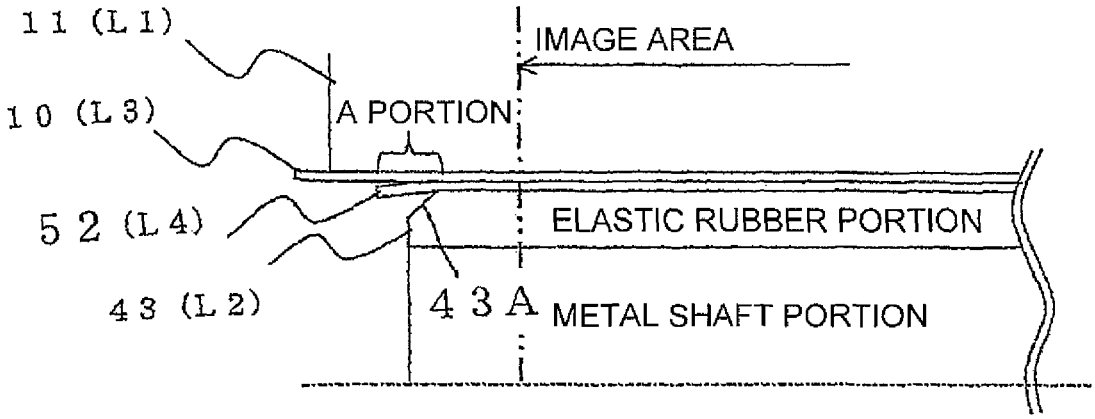
FIG. 6 illustrates a still further embodiment of the invention.

FIG. 6 illustrates a secondary transfer unit for preventing arrival of the liquid developer on the back surface of the transfer material support belt 52 in the second embodiment. According to this embodiment, the width L3 of the intermediate transfer belt 10 is larger than the width L4 of the transfer material support belt 52 similarly to the first embodiment. In this structure, both ends of the intermediate transfer belt 10 are positioned away from both ends of the transfer material support belt 52. Thus, adhesion of the liquid developer to the transfer material support belt 52 from the end of the intermediate transfer belt 10 is prevented. Accordingly, the liquid developer does not reach the back surface from the end of the transfer material support belt 52.

According to the second embodiment, a beveled portion 43A is formed at the end of the first secondary transfer roller 43. In this structure, a clearance between the surface of the intermediate transfer belt 10 and the end (A portion) of the transfer material support belt 52 is secured by producing sufficient length of the end (A portion) not directly pressed by the first secondary transfer roller 43 of the transfer material support belt 52 to increase deformation of the end (A portion) toward the inside. Accordingly, adhesion of surplus liquid developer to the transfer material support belt 52 from the intermediate transfer belt 10, and thus arrival of the liquid developer on the back surface of the transfer material support belt 52 are prevented. While the contact portion between the belt drive roller (first backup roller) and the first secondary transfer roller 43 is shown in FIG. 6, similar advantage is offered on the contact portion between the following roller 12 (second backup roller) and the second secondary transfer roller 44.

Table 2 shows the relationship between the respective rollers and belts and the width of the transfer material support belt cleaner in the first and second embodiments.

TABLE 2

| | Symbol | Width (mm) |
|---|---|---|
| Intermediate transfer belt 10 | L3 | 350 |
| Belt drive roller 11 | L1 | 346 |
| First secondary transfer roller 43 | L2 | 340 |
| Transfer material support belt 52 | L4 | 344 |
| Following roller 12 | L6 | 346 |
| Second secondary transfer roller 44 | L7 | 340 |
| Transfer support belt cleaner 53 | L5 | 334 |
| Tension roller 51 | L8 | 340 |

Figure 7A:
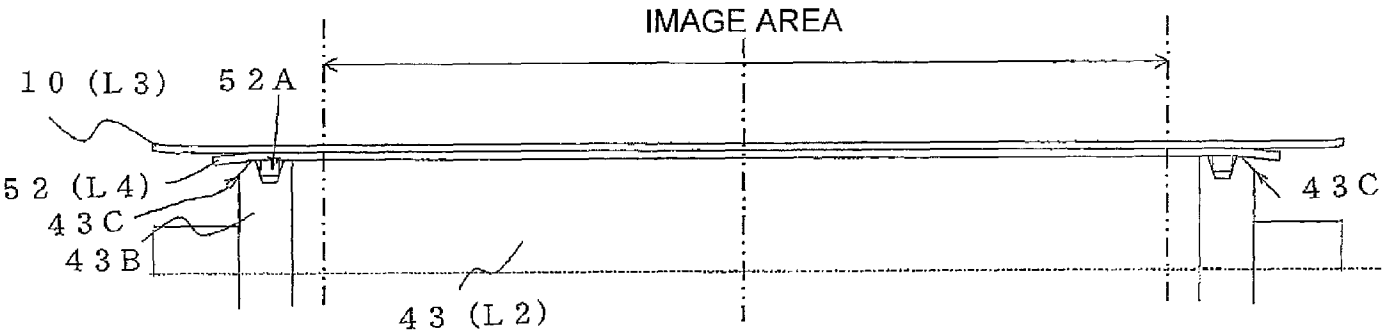
FIGS. 7A and 7B illustrate a still further embodiment of the invention.
Figure 7B:
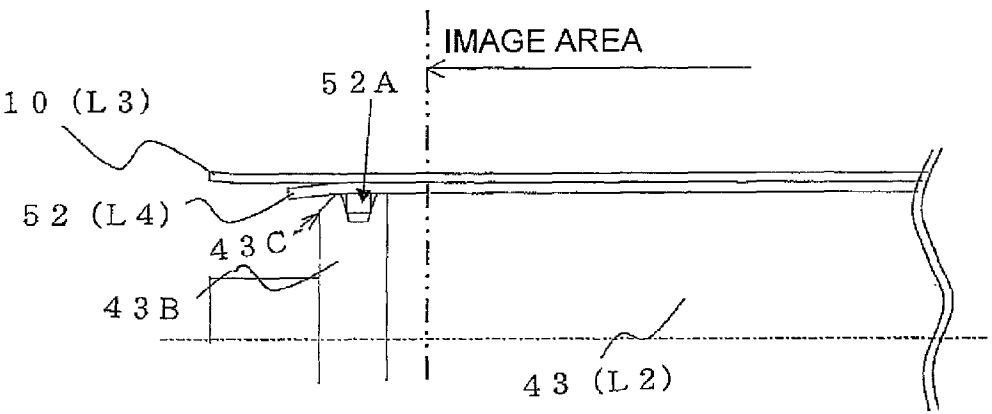

FIGS. 7A and 7B illustrate a secondary transfer unit and a part of the enlarged secondary transfer unit which prevents arrival of liquid developer on the back surface of the transfer material support belt 52 and regulates zigzag movement of the transfer material support belt 52 in a third embodiment. According to this embodiment, the width L3 of the intermediate transfer belt 10 is larger than the width L4 of the transfer material support belt 52 similarly to the first and second embodiments. In this structure, both ends of the intermediate transfer belt 10 are positioned away from both ends of the transfer material support belt 52. Thus, adhesion of the liquid developer to the transfer material support belt 52 from the end of the intermediate transfer belt 10 is prevented. Accordingly, the liquid developer does not reach the back surface from the end of the transfer material support belt 52.

According to the third embodiment, a bead 52A is provided on the back surface of the end of the transfer material support belt 52. A pulley 43B having a groove for guiding the bead 52A is provided at the end of the first secondary transfer roller 43 to regulate zigzag movement of the transfer material support belt 52. A beveled portion 43C is formed at the end of the pulley 43B. The width L2 of the first secondary transfer roller 43 including the pulley 43B is smaller than the width L4 of the transfer material support belt 52. In this structure, a clearance between the surface of the intermediate transfer belt 10 and the end (A portion) of the transfer material support belt 52 is produced to prevent adhesion of surplus liquid developer to the transfer material support belt 52 from the intermediate transfer belt 10 and arrival of the liquid developer on the back surface of the transfer material support belt 52. While the contact portion between the belt drive roller (first backup roller) and the first secondary transfer roller 43 is shown in FIGS. 7A and 7B, similar advantage is offered on the contact portion between the following roller 12 (second backup roller) and the second secondary transfer roller 44.

Figure 8A:
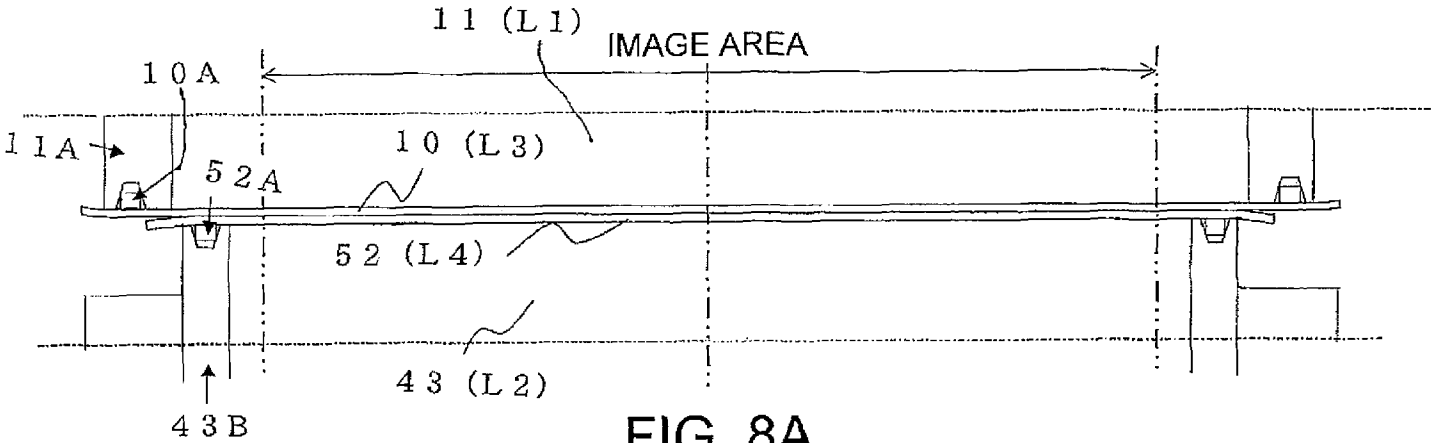
FIGS. 8A and 8B illustrate a still further embodiment of the invention.
Figure 8B:
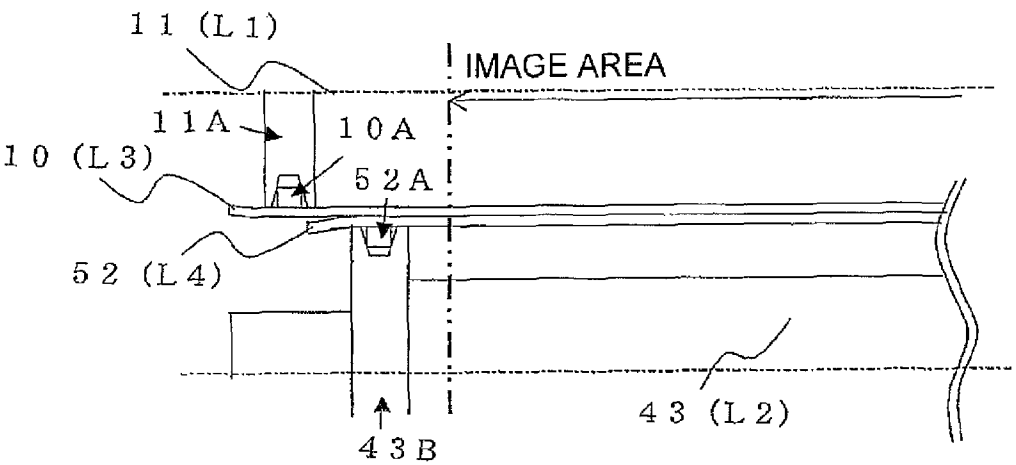

FIGS. 8A and 8B illustrate a secondary transfer unit and a part of the enlarged secondary transfer unit which prevent arrival of liquid developer on the back surface of the transfer material support belt 52 and regulate zigzag movement of the intermediate transfer belt 10 and the transfer material support belt 52 in a fourth embodiment. According to this embodiment, the width L3 of the intermediate transfer belt 10 is larger than the width L4 of the transfer material support belt 52 similarly to the first, second and third embodiments. In this structure, both ends of the intermediate transfer belt 10 are positioned away from both ends of the transfer material support belt 52. Thus, adhesion of the liquid developer to the transfer material support belt 52 from the end of the intermediate transfer belt 10 is prevented. Accordingly, the liquid developer does not reach the back surface from the end of the transfer material support belt 52.

According to the fourth embodiment, the bead 52A is disposed on the back surface of the end of the transfer material support belt 52. The pulley 43B having the groove for guiding the bead 52A is provided at the end of the first secondary transfer roller 43 to regulate zigzag movement of the transfer material support belt 52. A bead 10A is provided at the end on the back surface of the intermediate transfer belt 10. A pulley 11A having a groove for guiding the bead 10A is provided at the end of the belt drive roller 11 to regulate zigzag movement of the intermediate transfer belt 10. Table 3 shows the width L3 of the intermediate transfer belt 10 and the width of the belt drive roller 11 (including pulley 11A) in the fourth embodiment.

TABLE 3

| | Symbol | Width (mm) | |
|---|---|---|---|
| Intermediate transfer belt 10 | L3 | 350 | |
| Belt drive roller 11 | L1 | 345 | Length of belt drive roller: 320<br>Pulleys left and right: 10 for each,<br>Total: 345 mm |

According to the fourth embodiment, the width L3 of the intermediate transfer belt 10 is larger than the width L1 of the belt drive roller including the pulley 11A.

Figure 9A:
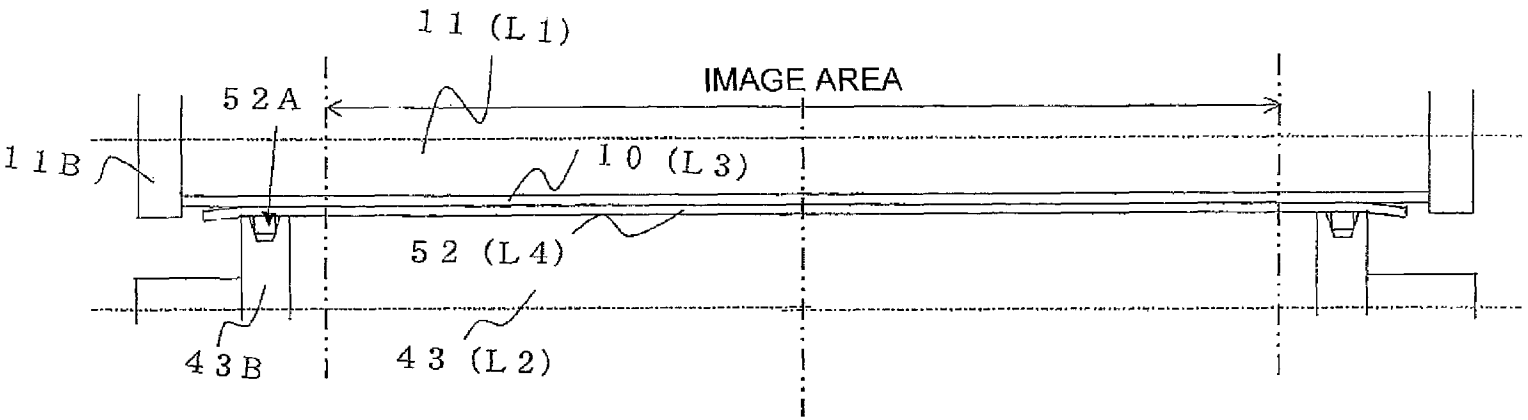
FIGS. 9A and 9B illustrate a still further embodiment of the invention.
Figure 9B:
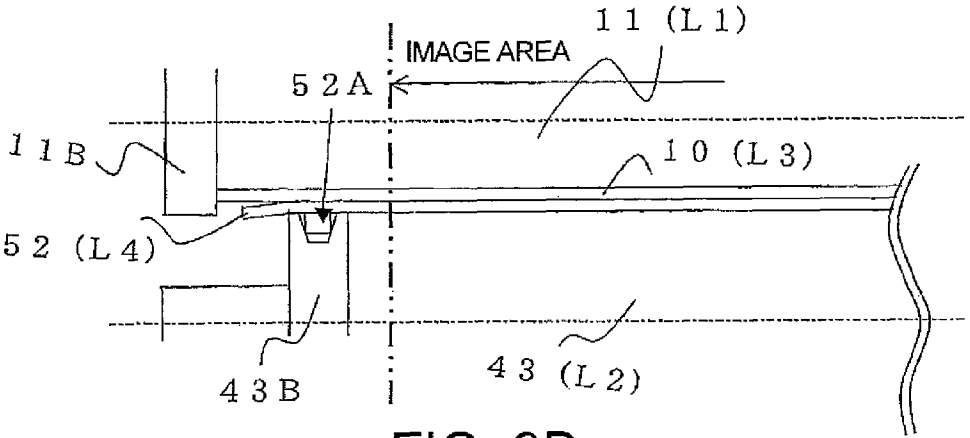

FIGS. 9A and 9B illustrate a secondary transfer unit and a part of the enlarged secondary transfer unit which prevent arrival of liquid developer on the back surface of the transfer material support belt 52 and regulate zigzag movement of the intermediate transfer belt 10 and the transfer material support belt 52 in a fifth embodiment. According to this embodiment, the width L3 of the intermediate transfer belt 10 is larger than the width L4 of the transfer material support belt 52 similarly to the first, second, third and fourth embodiments. In this structure, both ends of the intermediate transfer belt 10 are positioned away from both ends of the transfer material support belt 52. Thus, adhesion of the liquid developer to the transfer material support belt 52 from the end of the intermediate transfer belt 10 is prevented. Accordingly, the liquid developer does not reach the back surface from the end of the transfer material support belt 52.

According to the fifth embodiment, the bead 52A is disposed on the back surface of the end of the transfer material support belt 52. The pulley 43B having the groove for guiding the bead 52A is provided at the end of the first secondary transfer roller 43 to regulate zigzag movement of the transfer material support belt 52. A flange 11B having a larger diameter than that of the outside diameter of the belt drive roller 11 is provided at the end of the belt drive roller 11 to regulate zigzag movement of the intermediate transfer belt 10. Table 4 shows the width L3 of the intermediate transfer belt 10 and the width of the belt drive roller 11 (including flange 11B) in the fifth embodiment.

TABLE 4

| | Symbol | Width (mm) | |
|---|---|---|---|
| Intermediate transfer belt 10 | L3 | 350 | |
| Belt drive roller 11 | L1 | 370 | Length of belt drive roller: 350<br>Flanges left and right: 10 for each,<br>Total: 370 mm |

According to the fifth embodiment, the width L3 of the intermediate transfer belt 10 is smaller than the width L1 of the belt drive roller including the flange 11B.

Figure 10:
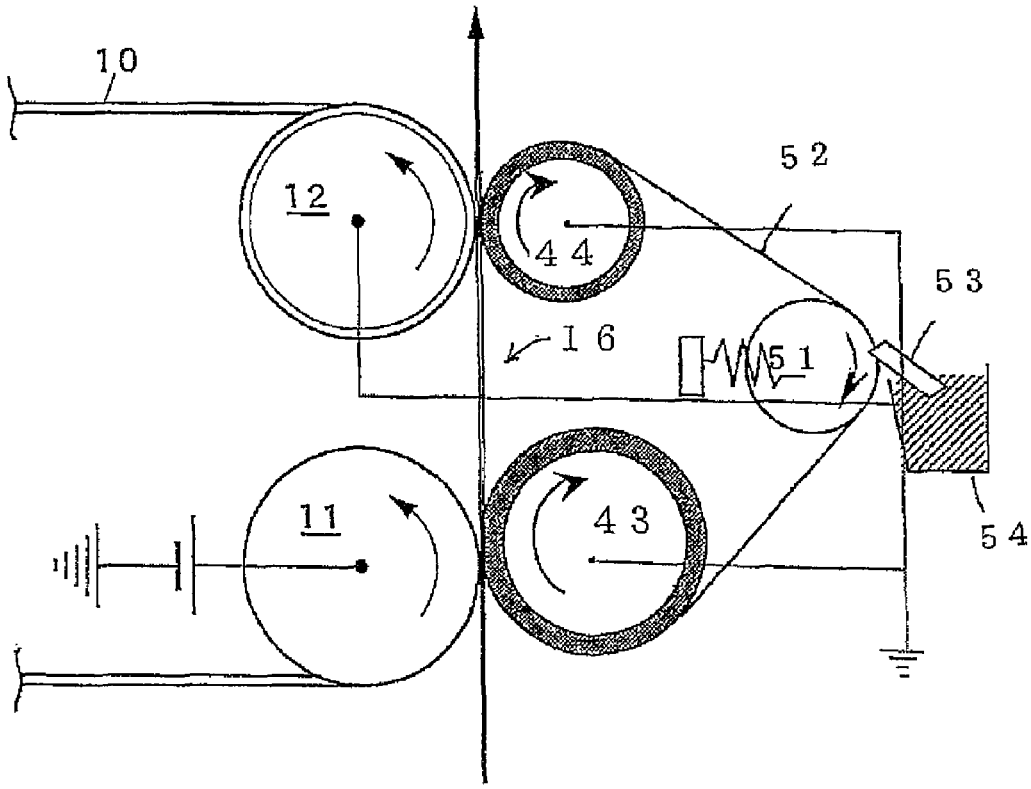
FIG. 10 illustrates a still further embodiment of the invention.

FIG. 10 illustrates the condition of secondary transfer which uses the transfer device having the widths of the roller, belt and cleaner set according to any of the first through fifth embodiments. The press contact load of the second secondary transfer roller 44 given on the belt following roller 12 is 500 gf, and the press contact load of the first secondary transfer roller 43 given on the belt drive roller 11 is 60 kgf. Thus, the press contact load of the second secondary transfer roller 44 on the following roller 12 is smaller than the press contact load of the first secondary transfer roller 43 on the belt drive roller 11. The distance between the belt drive roller 11 and the first secondary transfer roller 43 and the distance between the following roller 12 and the second secondary transfer roller 44 are set at 28 mm. Direct current voltage (DC) as the transfer bias voltage in the range from +600 to 2,0000V is applied with 200V for each to the belt drive roller 11. The other rollers 12, 43, and 44 are grounded (GND). The driving roller of the transfer material support belt 52 is the first secondary transfer roller 43. The peripheral speed of the intermediate transfer belt 10 is 214 mm/sec.

The transfer toner concentration on the intermediate transfer belt before secondary transfer and the residual toner concentration on the intermediate transfer belt after secondary transfer are measured by using X-Lite optical measurement, and the transfer efficiency is calculated by the following equation:

transfer efficiency [%] for paper={(toner concentration before transfer−residual toner concentration after transfer)/(toner concentration before transfer)}×100.

Every time direct current voltage (DC) as transfer bias voltage in the range from +600 to 2000V is applied to the belt drive roller 11 with 200V for each, printing is performed on several sheets of Fuji Xerox J paper. Then, the toner concentration before transfer discussed above and the residual toner concentration after transfer discussed above are measured for each printing to calculate transfer efficiency, and the average transfer efficiency is obtained. According to the results of the experiment in the first and second embodiments, the transfer efficiency is 95% in the structure as the combination of the belt drive roller 11, the first secondary transfer roller 43, the following roller 12, the second secondary transfer roller 44, and the multilayer intermediate transfer belt 10 having the transfer material support belt 52 and the elastic layer 10*b*. In this case, winding of paper around the intermediate transfer belt 10 is not caused. According to the result of the experiment, the transfer efficiency is 85% in the structure as the combination of the belt drive roller 11, the first secondary transfer roller 43, and the multilayer intermediate transfer belt 10 having the elastic layer 10*b* as the structure including one backup roller and one secondary transfer roller for printing under the similar condition. Thus, it is conformed that preferable transfer with improved transfer efficiency and separability of transfer material can be performed in the invention. Moreover, arrival of liquid developer on the back surface from the end of the transfer material support belt 52 can be prevented.

The entire disclosure of Japanese Patent Application Nos: 2007-237788, filed Sep. 13, 2007 and 2008-145727, filed Jun. 3, 2008 are expressly incorporated by reference herein.

What is claimed is:

1. A transfer device, comprising:

an image carrier belt;

a first roller around which the image carrier belt is wound;

a second roller around which the image carrier belt is wound;

a first transfer roller contacting the first roller via the image carrier belt;

a second transfer roller contacting the second roller via the image carrier belt; and a transfer belt wound around the first transfer roller and the second transfer roller, wherein a width L3 of the image carrier belt and a width L4 of the transfer belt have the relationship of L3>L4, and beveled portions are formed at the ends of the first and second transfer rollers.

2. The transfer device according to claim 1, wherein:

the relationship between the width L4 of the transfer belt, a width L2 of the first transfer roller, and a width L7 of the second transfer roller have the relationship of L4>L2 and L4>L7.

3. The transfer device according to claim 1, further comprising a transfer belt cleaner contacting the first transfer roller via the transfer belt, wherein a width L5 of the transfer belt cleaner and the width L2 of the first transfer roller have the relationship of L5<L2.

4. The transfer device according to claim 1, further comprising:

a tension roller which gives tension to the transfer belt; and a transfer belt cleaner contacting the tension roller via the transfer belt, wherein the width L5 of the transfer belt cleaner and the width L8 of the tension roller have the relationship of L5<L8.

5. A transfer device comprising:

an image carrier belt;

a first roller around which the image carrier belt is wound;

a second roller around which the image carrier belt is wound;

a first transfer roller contacting the first roller via the image carrier belt;

a second transfer roller contacting the second roller via the image carrier belt;

a transfer belt wound around the first transfer roller and the second transfer roller;

a bead provided at least one end of both ends of the transfer belt; and a pulley which guides the bead provided at least one end of both ends of the first and second transfer rollers as well as has a beveled portion at the end, wherein a width L3 of the image carrier belt and a width L4 of the transfer belt have the relationship of L3>L4.

6. An image forming apparatus, comprising:

a latent image carrier on which electrostatic latent image is formed;

a developing device which develops the electrostatic latent image;

an image carrier belt on which an image of the latent image carrier is transferred;

a first roller around which the image carrier belt is wound;

a second roller around which the image carrier belt is wound;

a first transfer roller contacting the first roller via the image carrier belt;

a second transfer roller contacting the second roller via the image carrier belt; and a transfer belt wound around the first transfer roller and the second transfer roller, wherein a width L3 of the image carrier belt and a width L4 of the transfer belt have the relationship of L3>L4, and beveled portions are formed at the ends of the first and second transfer rollers.

7. The image forming apparatus according to claim 6, wherein:

the relationship between the width L4 of the transfer belt, a width L2 of the first transfer roller, and a width L7 of the second transfer roller have the relationship of L4>L2 and L4>L7.

8. The image forming apparatus according to claim 6, further comprising:

a transfer belt cleaner contacting the first transfer roller via the transfer belt, wherein the width L5 of the transfer belt cleaner and the width L2 of the first transfer roller have the relationship of L5<L2.

9. An image forming apparatus comprising:

a latent image carrier on which electrostatic latent image is formed;

a developing device which develops the electrostatic latent image;

an image carrier belt on which an image of the latent image carrier is transferred;

a first roller around which the image carrier belt is wound;

a second roller around which the image carrier belt is wound;

a first transfer roller contacting the first roller via the image carrier belt;

a second transfer roller contacting the second roller via the image carrier belt;

a transfer belt wound around the first transfer roller and the second transfer roller;

a bead provided at least one end of both ends of the transfer belt; and a pulley which guides the bead provided at least one end of both ends of the first transfer roller and/or the second transfer roller and has a beveled portion at the end, wherein a width L3 of the image carrier belt and a width L4 of the transfer belt have the relationship of L3>L4.

* * * * *